235-382 SR
5/21/85 XR 4,519,088

United States Patent [19]
Rademacher et al.

[11] Patent Number: 4,519,088
[45] Date of Patent: May 21, 1985

[54] USAGE CONTROL SYSTEM

[75] Inventors: Darrell Rademacher, Freeville; Thomas Neville, Dryden, both of N.Y.; Roger T. Simpson, 365 E. King Rd., Ithaca, N.Y.

[73] Assignee: XCP, Inc., Dryden, N.Y. ; by said Darrell Rademacher and Thomas Neville

[21] Appl. No.: 404,754

[22] Filed: Aug. 3, 1982

[51] Int. Cl.[3] ..... G06M 3/02; G07F 5/10; G07F 7/02

[52] U.S. Cl. ..... 377/16; 377/8; 377/30; 377/38; 235/382; 328/129.1

[58] Field of Search ..... 377/7, 8, 16, 30, 38; 328/129.1

[56] References Cited

U.S. PATENT DOCUMENTS 3,427,441 2/1969 Swords ..... 377/8
3,641,321 2/1972 Tonne ..... 377/16
3,917,924 11/1975 Linne ..... 377/8
3,921,875 11/1975 Hengstler et al. ..... 377/38
3,932,732 1/1976 McAllister et al. ..... 377/38
4,128,756 12/1978 Nagano et al. ..... 377/8
4,162,530 7/1979 Kusui et al. ..... 377/38
4,258,837 3/1981 Manos et al. ..... 377/7

*Primary Examiner*—John S. Heyman
*Attorney, Agent, or Firm*—Barnard & Brown

[57] ABSTRACT

A usage control system for copiers and the like, adapted to connect to the copier through the existing accounting system connection. A check-operated device, such as a coin box or magnetic card reader, supplies the copier with a signal to initiate operation. When the operation has progressed, the copier supplies a signal intended to increment the counter in the accounting system. After a suitable delay, permitting completion of the copy cycle, the operate signal is reset, and the copier is disabled. As an option, power to the copier may be controlled. The system requires no internal connections or modifications to the copier.

11 Claims, 3 Drawing Figures

USAGE CONTROL SYSTEM

BACKGROUND OF THE INVENTION

The invention pertains to check-operated devices. More specifically, the invention pertains to check-controlled devices for controlling usage of copying machines and the like.

Coin- or token-operated copying machines have become commonplace in recent years in libraries and other public places. Usually, the coin box is bolted onto the copier or its stand and wired internally to the copier, or is built into the copier by the copier manufacturer. In either mode, the coin system is connected to the internal circuitry of the copier at whatever point is appropriate. Usually, a signal will be supplied to start printing, perhaps in series or parallel with, or replacing, the "print" button of the copier. A signal may be picked off at some point in the copier to cause the reset of the coin mechanism in preparation for the next copy.

Recently, however, copier manufacturers have begun to object to outside companies attaching peripheral equipment to their copiers internally. Some companies refuse to service copies which have been so modified, others require the copier owner to purchase an expensive "foreign attachment device." Leases on machines may prohibit internal attachments. In any case, internal modifications to copiers cause problems when service is required. This situation has proven difficult for the copier-peripheral industry to deal with, and has hindered the sale of check-operated copier controllers by other than the manufacturers themselves. The problem to be solved, then, was to find a way to connect an external controller to a copier without internal connections.

This problem was addressed in U.S. Pat. No. 3,551,652, issued in 1970 to Faude, and assigned to Hecon Corporation. Faude provided an accounting system based upon the "Key-Counter®," an electromagnetic counter built into a plug. Inserting the key counter into its receptacle turned on the AC power to the copier. The power surge caused by a copy being made was detected and counted on the plug-in counter. Thus, Faude's system was based entirely on the use of AC line control and sensing to avoid internal connections. Unfortunately, the system proposed by Faude will not work with modern copiers, since the periodic cycling of the high-output heaters used in today's copying machines will cause false counting. Moreover, the power surges as copies are made are not longer as marked as in early machines. Finally, many modern machines have long warm-up periods, or circuits which must remain active, making AC control impractical. In a coin-operated environment, this system would never have been practicable as the machine would suffer from being powered up and shut down for each coin (if it would work at all if shut down, as noted above). Also, control of the machine could not be precise enough to allow only one copy to be made per coin, while not stopping the machine too quickly to allow the first copy to complete.

One feature of Faude's system, however, has become commonplace. The Hecon Key-Counter® itself (see also Faude, U.S. Pat. No. 3,436,530) has become the basic usage control and accounting system for copiers, available with small variations from virtually all copier manufacturers. Most copiers have the capability of installing the mating socket for the Key-Counter® (reg. tmk. Hecon Corp.) or Auditron® (reg. tmk. Xerox corp), and many copier owners have taken advantage of this accounting control system.

In operation, the key-counter usually has six pins, two of which are jumpered in the key to complete a circuit in the copier, enabling the copier to operate, and two of which are connected to the electromagnetic counter in the key. (The other two pins are normally unused). Current industry practice has nearly standarized the shape, pin connections, and size of the key-counter key (2 sizes) and the voltages used (2 systems).

SUMMARY OF THE INVENTION

The invention, then, presents a system of interfacing external control equipment, especially check-controlled equipment, to copiers or the like using the existing accounting system socket. Since the Auditron® socket, or equivalent, is provided by the copier manufacturer, the ban on internal connections is avoided. The copier may be enabled by a contact closure, and a signal is available to indicate that a copy is being made. The near-standardization of the key-counter system allows a peripheral system which interfaces properly to be adaptable by the user to many different machines without internal modification to either the peripheral or the copier.

Two signals are used, accessed through a plug mating with the existing accounting system socket on the copier. The first is the "print enable" signal, a contact closure (or contact closure with resistor (Xerox system)), supplied to the copier by the usage controller in response to a coin or other check. This signal must be held throughout the copy cycle, but not longer, lest extra copies be made on single coin. The reset of the print enable signal is triggered by the second signal, a "copy made" or "count" pulse of typically 24 volts (93 volts if Xerox, IBM or Kodak) supplied by the copier. The pulse may be at any point in the copy cycle, depending on the circuitry of copy machine. Therefore, a delay timer is used to delay the reset of the print enable until the copy has been delivered.

DESCRIPTION OF THE PREFERRED EMBODIMENT

Figure 1:
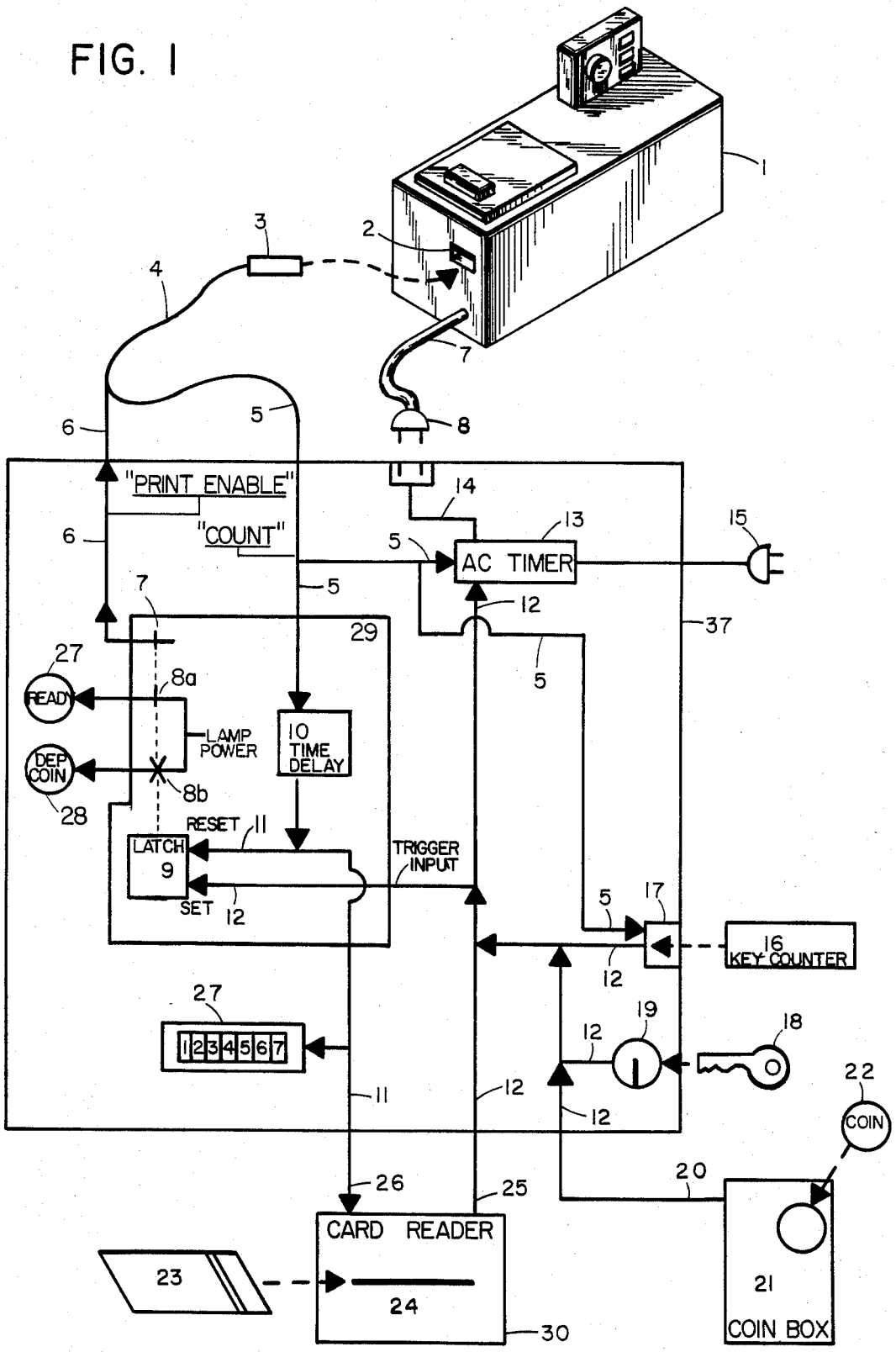
FIG. 1 shows a diagram of the preferred embodiment of the invention.
Figure 2:
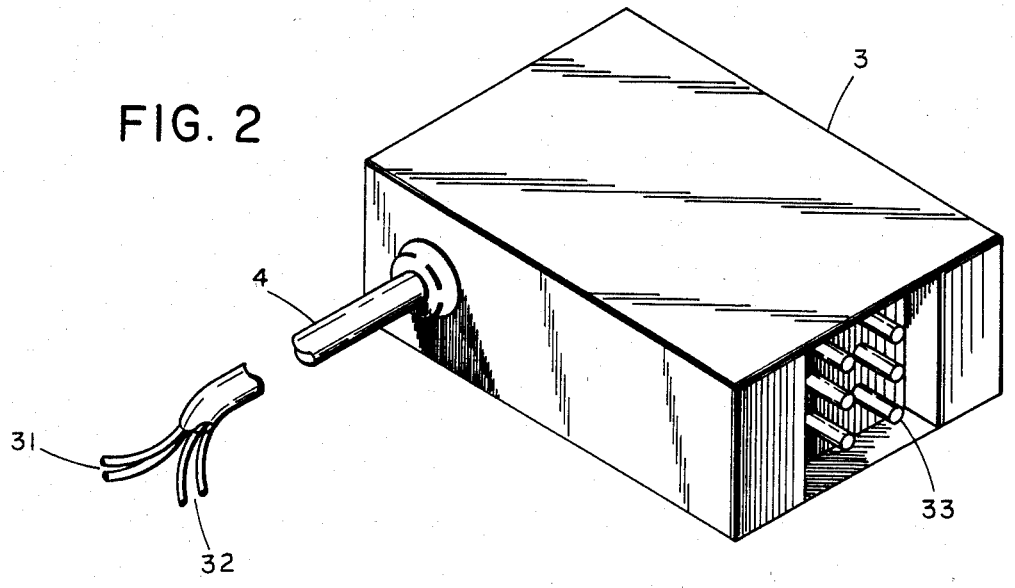
FIG. 2 shows a detail of the plug or key used to interface with the copier.

The heart of the system is the key-connector (3) and its controller (FIG. 1 (37)). The key connector (3), (shown from the plug end in FIG. 2), is of the correct size and shape to mate with the accounting system socket used in the copier (2). Two sizes are commonly used, the Hecon or Veeder-Root system used on most copiers and a slightly smaller Japanese version. Thus, only two connectors need be supplied to connect with the majority of copiers. The connector is most easily constructed from a standard key counter of the appropriate size without the counter mechanism. A cable (30) is routed from the appropriate pins (33) to the controller. At least two sets (31) (32) of conductors must be used, one for each signal.

FIG. 1 shows the invention diagrammatically. The key connector (3) plugs into the socket (2) on the copier (1). A cable (4) connects the key connector plug (3) to the controller (37), where the two signal lines-enable (6) and reset (5)-are split off as separate circuits.

The actuating circuit (29) comprises a latch (9), which may be any known sort of latching relay, common relay wired as a latch, or electronic latch or flip-flop type circuit. As illustrated, the latch may optionally have two sets of contacts, one (8) a double-throw type powering two optional lights (27) (28) through normally open (8*a*) and normally closed (8*b*) contacts, respectively, the operation of which is described below. The latch is latched by a "set" signal (12) and unlatched by a "reset" signal (11). A normally open set of contacts (7), or electronic equivalent, sends the "print enable" signal (6) to the copier. The "count" signal from the copier (5) activates a delay timer (10), which may be of any convenient electrical, electromechanical or electronic type, whose output, the "reset" signal (11), resets the latch (9) and removes the "print enable" signal (6).

The "set", or trigger signal (12) may be generated by a number of devices, here shown as multiple devices on one controller. In practice, one or more may be included in any given installation, depending on the wishes of the copier owner.

Shown is a coin box (21) generating a signal (20) in response to the deposit of a coin (22), or perhaps a plurality of coins of different values. In the latter case, a totalizer may be built-in to the box to total the coins deposited, generating a signal when the total price of a copy is deposited.

Another possible source of the set trigger signal (12) is an encoded card system (30) such as the Venda Card TM system marketed by the assignee hereof. Such a system uses cards (23) encoded with a value representing a given amount of usage of the machine, either in dollars or number of copies. When the card is inserted into a reader slot (24) the usage remaining is compared with that required, and a signal is generated at the unit output (25) if enough usage remains to pay for a copy. The reset signal (11) is fed to an input (26), causing the usage to be subtracted from the amount remaining. If enough remains for another operation, the sequence is repeated. The new balance is re-encoded on the card, and may be displayed.

Other check-controlled devices, such as bill changers, token boxes, etc., may be used in place of those shown, within the teachings of the invention.

Also shown are optional bypass devices, such as a key switch (19) and key (18), or a key-counter socket (17) accepting a key counter (16). Either, or perhaps a simple hidden toggle switch, may be included to force a "set" trigger signal (12), so that the key operator may make copies without the need of inserting coins. A counter (27) may be included to total usage.

Another optional circuit which may be included in the preferred embodiment of the invention is an AC control and, optionally, timer (13). The circuit has an input for the AC line (15) power, and a switched output (14) into which the copier is plugged (8). A "set" signal (12) causes the switched outlet to turn on (if it's not already on), powering the copier. If a power-off timer is included, the count signal from the copier (5) triggers a delay period. After the delay, from 1.5 minutes to 3 hours, depending on the copier, the swtiched outlet (and thus the copier) is turned off. The delay is chosen such that the machine will not shut down between copies in normal use. The delay is set for a much longer period for machines with extended warm-up times. At the longest value, the copier is effectively turned on automatically for its first use of the day, and remains active all day.

Figure 3:
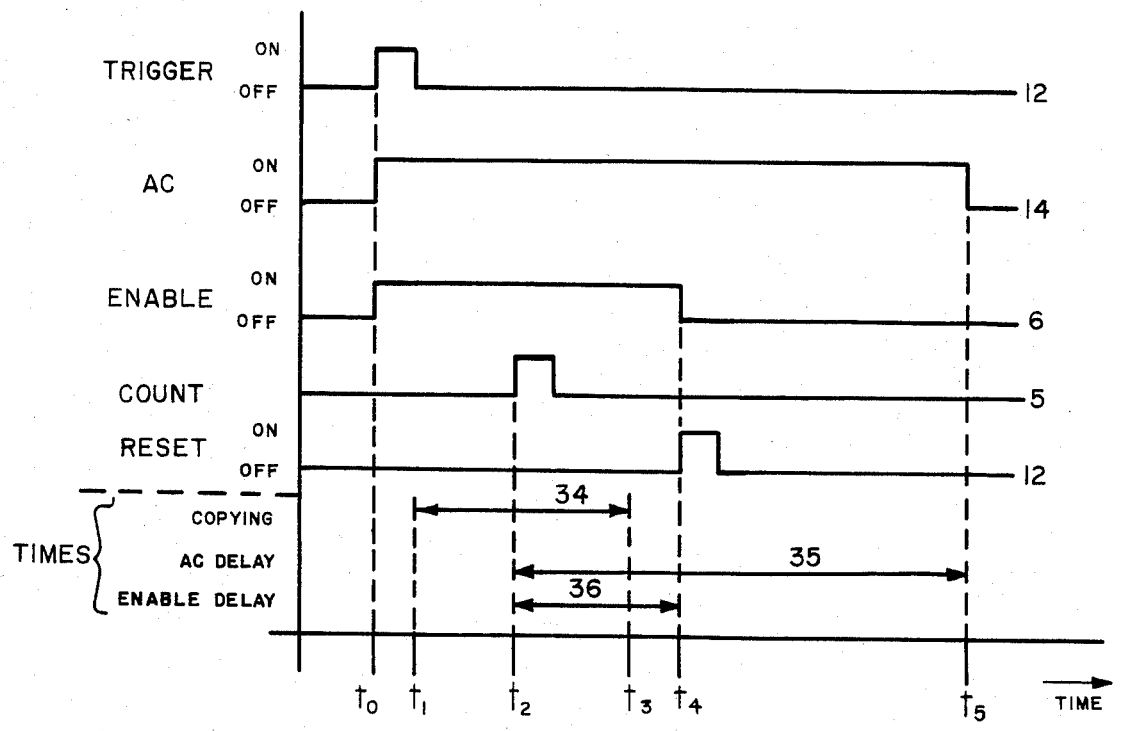
FIG. 3 is a timing diagram of system operation.

FIG. 3 shows the timing of the operation of the invention. Referring to that figure and FIG. 1, a typical operation is as follows: Before operation, all signals are "off" (assuming no use has yet been made). If so equipped, the "deposit coin" light (28) is lit through a normally closed contact (8*b*) of the latch (9). At time t0 a coin (22) is deposited in the coin box (21) causing the coin box output (20) to briefly generate a set signal (12). Almost immediately, the latch (9) pulls in, generating the enable signal (6) through normally open contacts (7) and the AC output is switched on (14). If so equipped, the "deposit coin" light (28) is turned off, and a "ready" light on (27). The copier is started by pushing its "print" button, or equivalent, and copying starts at t1. Some time later t2 the copier generates a count pulse (5), which begins the timer (10) delay. Copying ends at t3. After a delay of 0.25 to 4 seconds (36), depending on the cycle length of the copier, the timer generates a reset signal (11), the latch (9) deactivates, and the enable signal (6) is reset shortly after the end of the copy cycle t4. The "ready" light (27) is switched off, and "deposit coin" (28) back on. The delay (36) is set to make the time between t3 and t4 as short as possible. After a longer delay (35) the AC power (14) is switched off at (t5).

Although the embodiments presented herein are directed at copying machines, it is to be understood that the invention may be used with any other machine presenting similar problems.

Accordingly, it is to be understood that the embodiments of the invention herein described are merely illustrative of the application of the principles of the invention. Reference herein to details of the illustrated embodiments are not intended to limit the scope of the claims which themselves recite those features regarded as essential to the invention.

We claim:

1. A usage control system for electrically powered machines for performing a function, such as copiers or the like, said machine requiring a first signal to initiate the desired function, and emitting a second signal related to the performance of the function; said machine having socket means for interconnection of external equipment giving access to at least said first and second signals; said machine being enabled to perform its function upon receipt of the first signal, and emitting the second signal on or before completion of the function; the system comprising:

a. plug means for interconnection of external equipment adapted to mate with said socket means;

b. control means, conductively attached to the plug means by a cable means having at least a first set of conductors for conveying the first signal from the control means to the machine through the plug socket means; and a second set for conveying the second signal from the machine to the control means through the socket and plug means; the control means comprising:

1. latch means having a first latched and second unlatched state, a set input causing the latch means to assume the latched state, a reset input causing the latch means to assume the unlatched state, and an output connected to the first set of conductors in the cable means whereby the first signal is sent to the machine when the latch means is in the latched state;

2. trigger input means connected to the set input of the latch means, whereby a signal at the trigger input means causes the latch means to assume the latched state;

3. delay timer means having an input connected to the second set of conductors of the cable means and a delayed output connected to the reset input of the latch means, said delayed output being adapted to apply a signal to the said reset input, causing the latch means to assume the unlatched state, said delay being chosen to be a period of time after receiving the second signal from the machine sufficient to permit the machine to complete a single incompleted function cycle;

c. check-operated means having an output adapted for activating the trigger input means of the control means in response to entry of a check by user.

2. The usage control system of claim 1 further comprising power supply means for supplying electrical power to the machine, having an input connected to the output of the check-operated means, a power input, and a switched power output whereby the machine may be supplied with power by switching the switched power output to the power input when the check-operated means is operated.

3. The usage control system of claim 2 in which the power supply means further comprises a second input connected to the second signal from the machine and power timer means for disconnecting the switched power output from the power input after a period of time measured from receipt of the second signal from the machine through the second input.

4. The usage control system of claim 3 in which the period of time of the power timer means is variable for a period of up to three hours.

5. The usage control system of claim 1 in which the time delay of the delay timer means is variable in a range from 0.25 to 4 seconds.

6. The usage control system of claim 1 in which the check operated means comprises means for supplying the signal to the output means in response to a plurality of user-supplied coins or tokens.

7. The usage control system of claim 1 further comprising bypass means for directly supplying the first signal to the first set of conductors of the cable means.

8. The usage control system of claim 1 in which the machine is a photocopy machine.

9. The usage control system of claim 8 in which the socket means is adapted to operation with a key counter type accounting system.

10. The usage control system of claim 1 in which the check operated means comprises means for supplying the signal to the output means in response to a user supplied encoded card means.

11. The usage control system of claim 10 in which the encoded card means comprises card means having a strip of magnetic material adapted to being encoded with data.

* * * * *

UNITED STATES PATENT AND TRADEMARK OFFICE

CERTIFICATE OF CORRECTION

PATENT NO. :4,519,088

DATED :May 21, 1985

INVENTOR(S) :Darrell Rademacher; Thomas Neville; and Roger T. Simpson

It is certified that error appears in the above-identified patent and that said Letters Patent is hereby corrected as shown below:

In the drawings, Figure 3, refernce number 12 next to the "reset" line should be reference number 11.

Signed and Sealed this

Third Day of March, 1987

*Attest:*

DONALD J. QUIGG

*Attesting Officer*

*Commissioner of Patents and Trademarks*